US006623083B1

(12) United States Patent
Risi

(10) Patent No.: US 6,623,083 B1
(45) Date of Patent: Sep. 23, 2003

(54) EQUIPMENTS FOR COLD MILLING OF THE ROAD SURFACE

(75) Inventor: Mirco Risi, San Giovanni in Persiceto (IT)

(73) Assignee: Simex Engineering Srl, San Giovanni in Persiceto (IT)

( * ) Notice: Subject to any disclaimer, the term of this patent is extended or adjusted under 35 U.S.C. 154(b) by 0 days.

(21) Appl. No.: 10/089,069

(22) PCT Filed: Jul. 13, 2000

(86) PCT No.: PCT/IB00/00954

§ 371 (c)(1),
(2), (4) Date: Apr. 5, 2002

(87) PCT Pub. No.: WO01/25545

PCT Pub. Date: Apr. 12, 2001

(30) Foreign Application Priority Data

Oct. 5, 1999 (IT) ..... BO99A0534

(51) Int. Cl.[7] ..... E21C 25/00
(52) U.S. Cl. ..... 299/39.4
(58) Field of Search ..... 299/39.1, 39.3, 299/39.4; 125/38; 83/478; 30/390, 391; 404/93

(56) References Cited

U.S. PATENT DOCUMENTS 3,965,787 A 6/1976 Plischke
4,938,537 A 7/1990 Rife, Jr. et al.

FOREIGN PATENT DOCUMENTS

GB 2 150 620 7/1985

*Primary Examiner*—Heather Shackelford
*Assistant Examiner*—Lisa M Saldano
(74) *Attorney, Agent, or Firm*—Oblon, Spivak, McClelland, Maier & Neustadt, P.C.

(57) ABSTRACT

Improvements to cold cutting equipment of road surfaces with independent side protection guards, integral with skids resting against the ground complete with curved slots with concave parts facing a central point, substantially coinciding with the center of rotation of a cutting drum. In the slots, a thrust pin and a guide pin are engaged, respectively, which allow the skids, integral with the side guards, to constantly maintain a chase cutting depth, within operational tolerance limits, so that it is not affected by oscillation caused by a variation of a position of a cutter supporting structure due to uneven ground or irregular movements of components that carry the road cutter structure.

1 Claim, 7 Drawing Sheets

EQUIPMENTS FOR COLD MILLING OF THE ROAD SURFACE

FIELD OF THE ART

This invention refers to the field of the constructional technique of cold cutting equipment of the road surface or similar surfaces. International reference class E 01 C.

STATE OF THE ART

Various types of cold cutting equipment of the road surface are known in literature concerning patents, specialised techical publications and present practice.

All this known equipment encounters the problem of eliminating the projection of cutting rubble to the side. This side projection of rubble not only entails a hazard for persons but also requires the costly removal of rubble from around the work area. This problem is specifically enhanced when the position of the cutter host vehicle varies due to uneven ground and to the movements of the components that carry the cutter. In these cases the operator is also obliged to intervene to keep the cutting equipment level in order to constantly maintain the cutting depth of the cutter.

In fact, when the position of the operating machine varies, the skids with the traditionally known side protection guards move off the ground at one of the ends leaving an escape gap for the rubble, allowing it to be cast out hazardously to the side and also altering the pre-setting depth.

This invention aims at resolving all these problems still encountered in known cutting equipment by achieving further improvements of economical achievement, utmost reliability and operational safety.

DESCRIPTION

The invention is now explained with reference to the schematic figures of the diagrams enclosed as an unbinding example.

Figure 1:
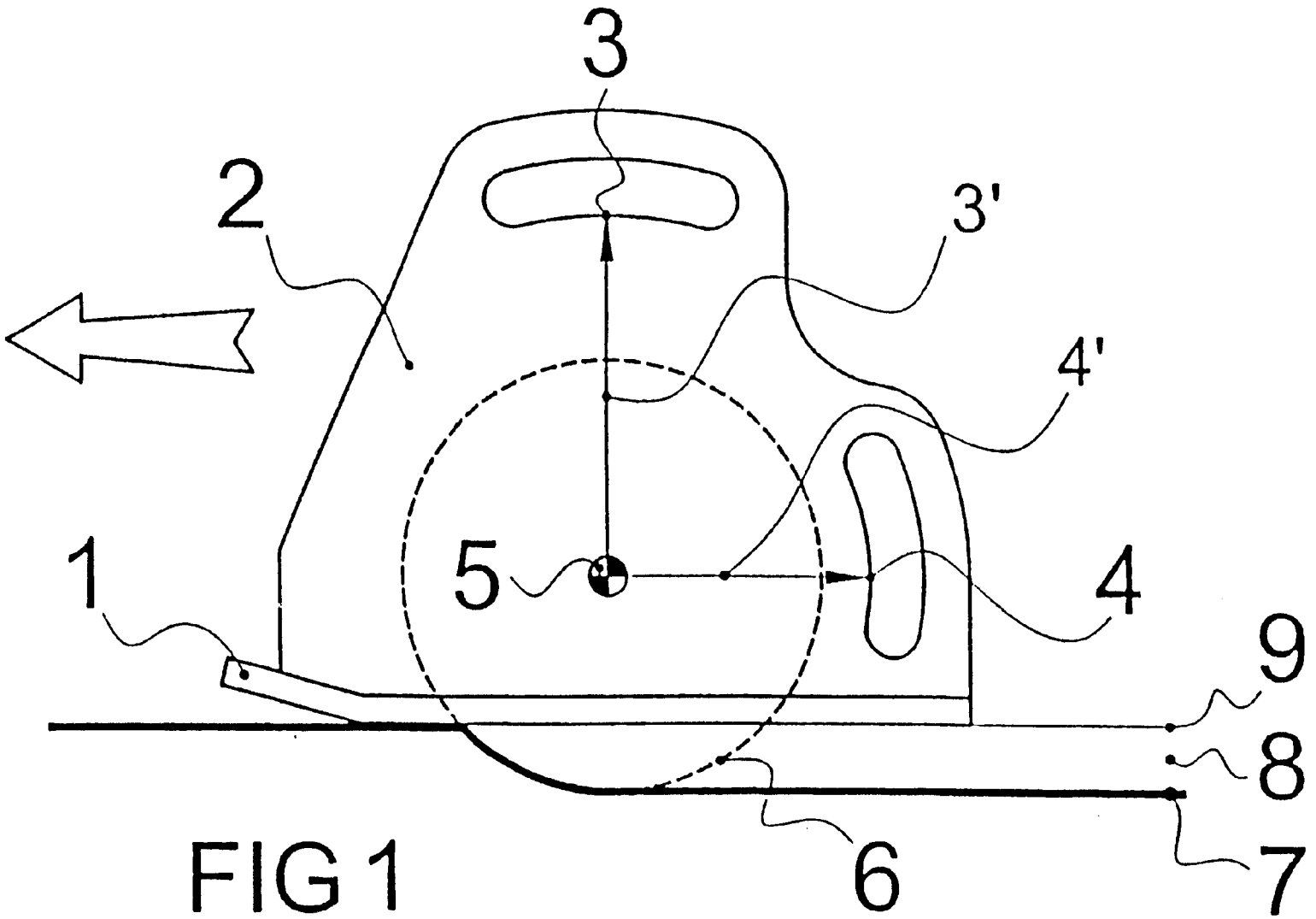

FIG. 1 schematically illustrates a side guard integral with its own depth skid. Some curved slots can be seen on the guard with the concave part facing the centre of the cutter.

Figure 2:
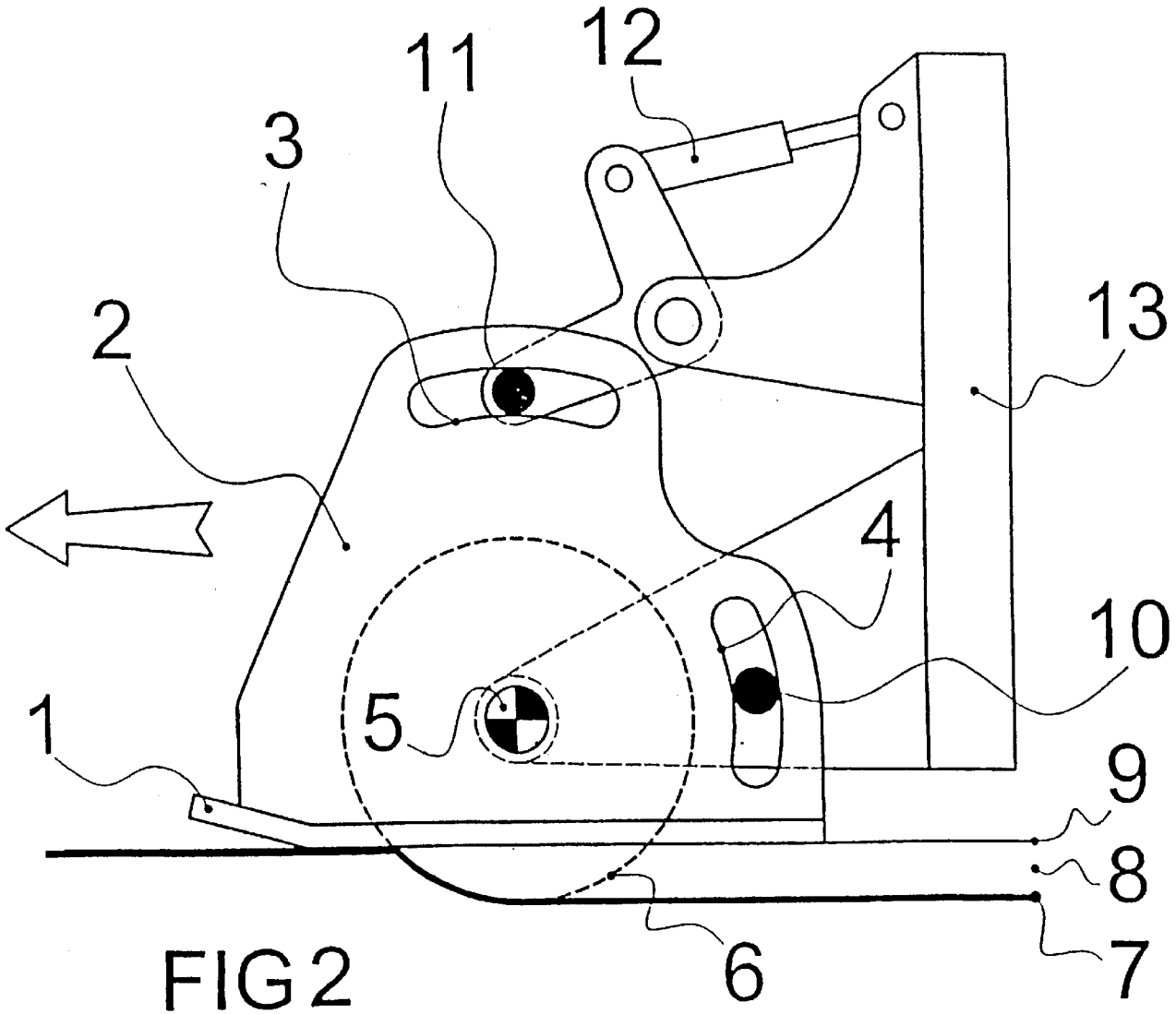

FIG. 2 illustrates a 'cutting device' installed on an operating machine, in the operational position with the skids resting against the ground.

Figure 3:
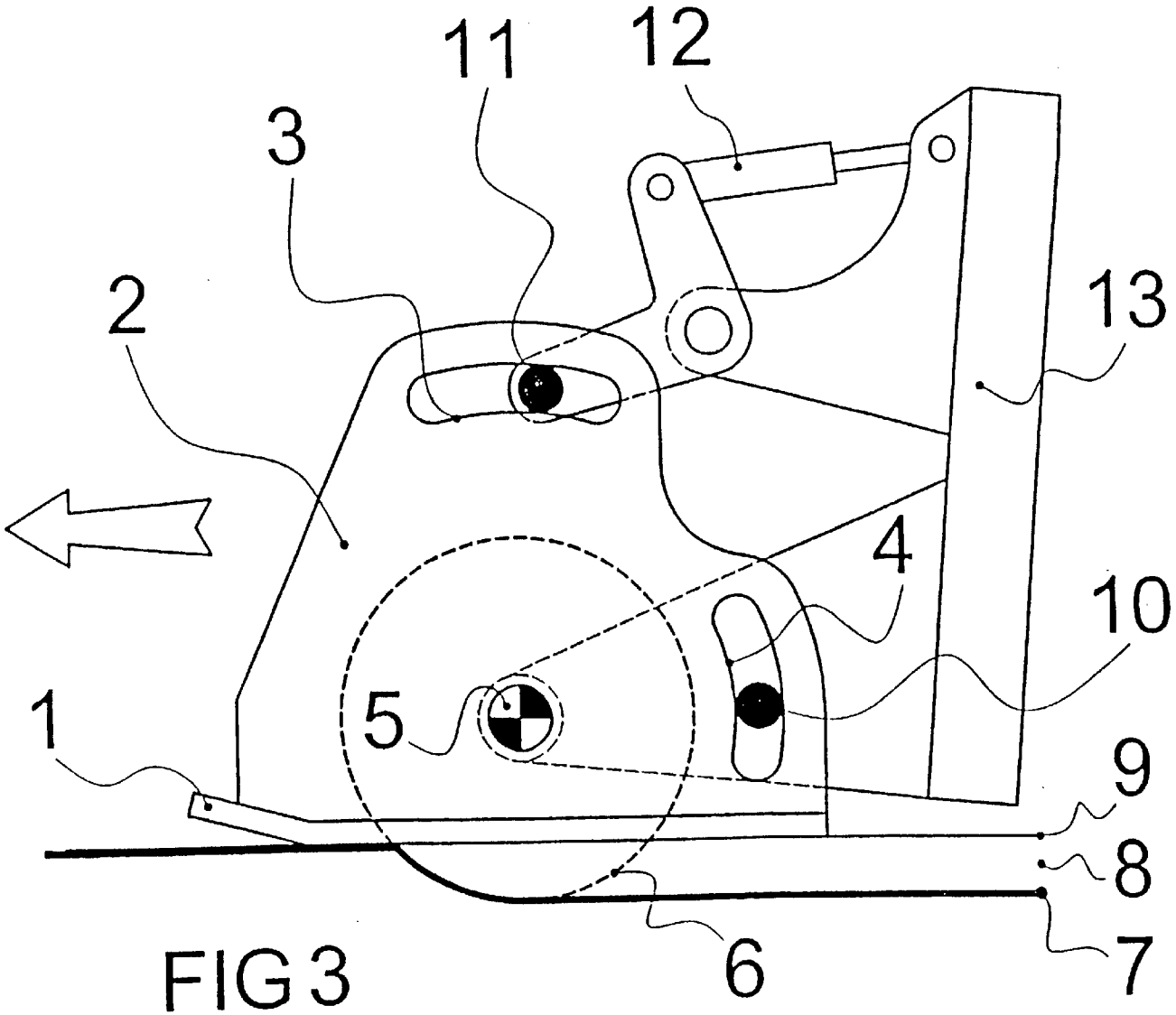
Figure 4:
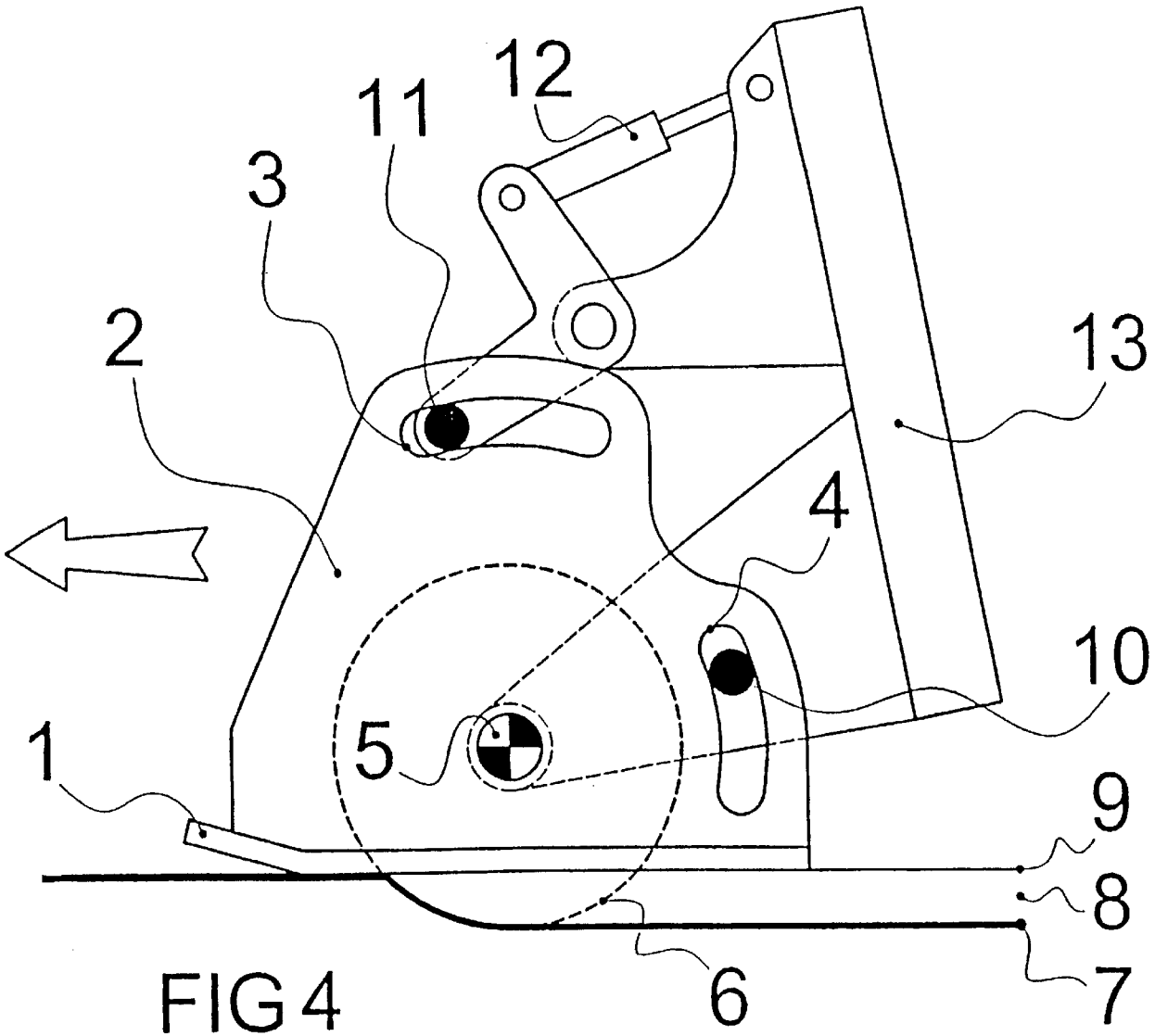

FIG. 3 and FIG. 4 enhance the position of the skids, again completely resting against the ground even when the cutter supporting structure (13) tilts. This situation is made possible thanks to the curved slots (3:4) on the side skid supporting guards with the concave part facing the centre of rotation (5) of the cutting drum (6). This configuration of the slots enables the supporting structure to substantially tilt about the center of rotation of the cutting drum, allowing a substantial portion of the skids to rest against the ground at all times and to constantly maintain a chase cutting depth within operation tolerance limits that will not be subject to oscillation caused by a variation of position of the cutter supporting structure due to uneven ground or irregular movements of the cutting equipment, so that the operator is not obliged to work to keep the cutting equipment level.

Figure 5:
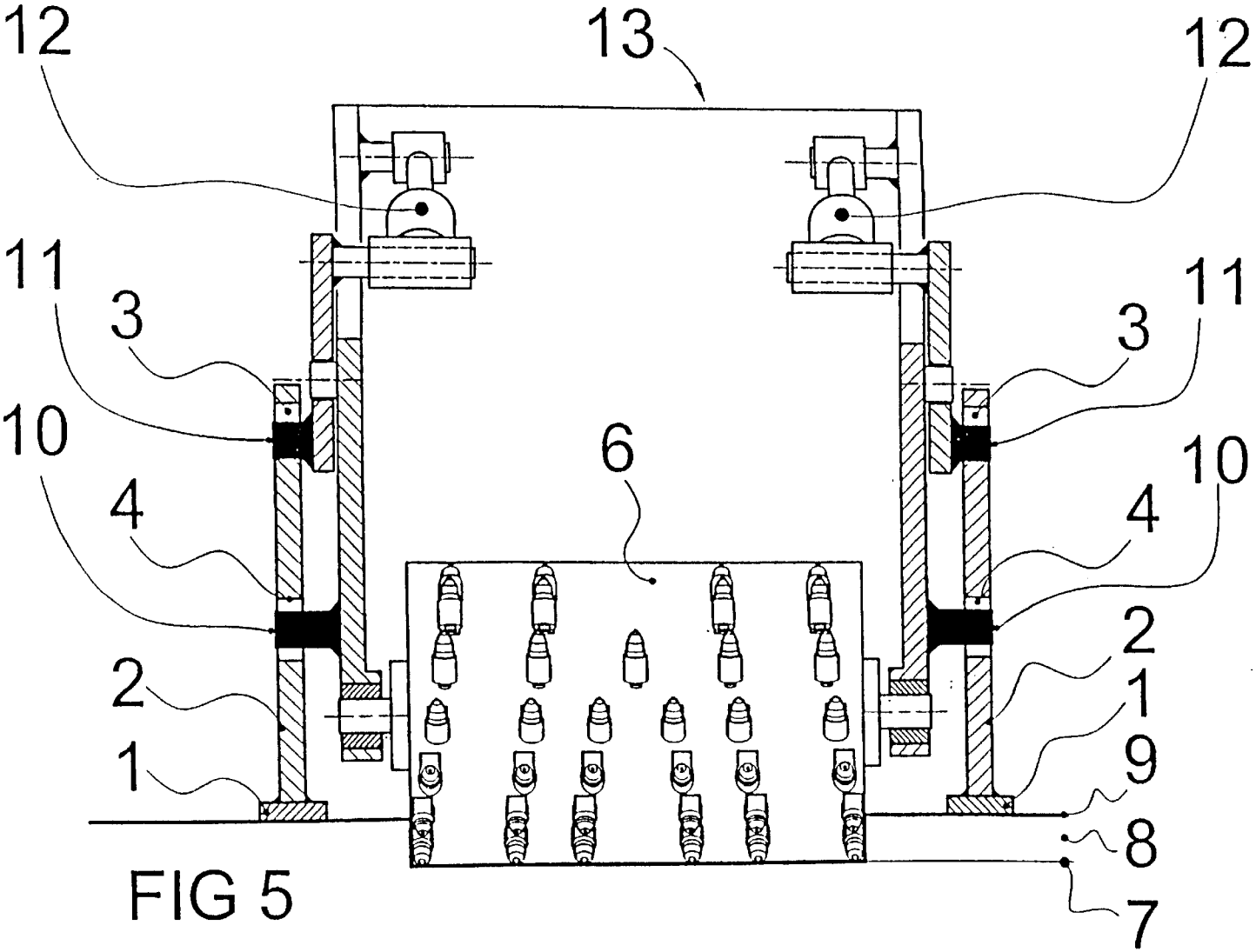

FIG. 5 schematically illustrates a section of the skid supporting guards fitted at the side of a road cutter. It can be seen that the cutting depth (8) is established by the position of the thrust pins (11) which keep the skids (1) against the ground (9) while the cutter (6) works on the bottom (7) of the chase. It is pointed out that this section, schematically illustrated in FIG. 5, is intended as executed by the pins (10:11) engaged in the relative slots (4 : 3).

Figure 6:
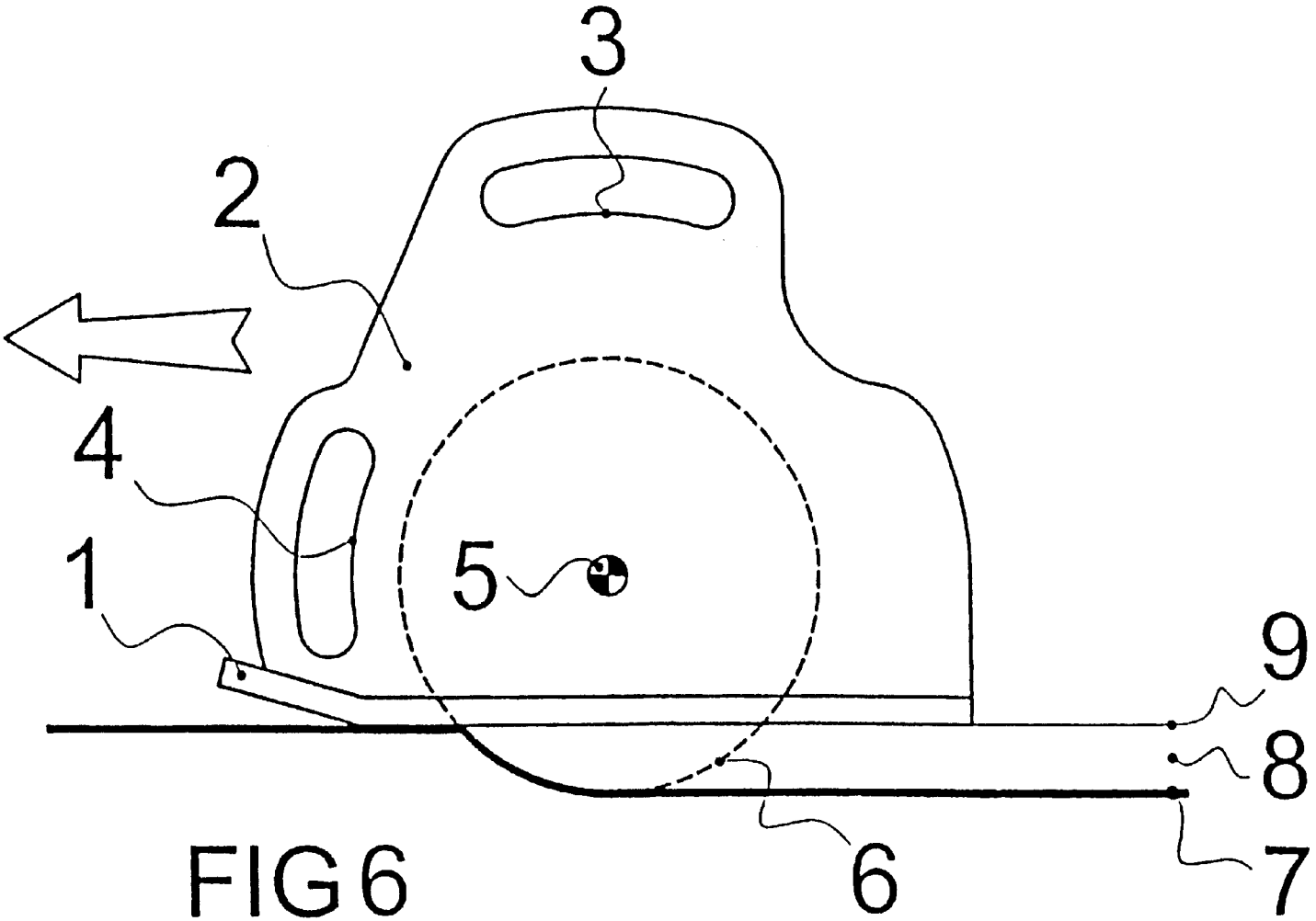
Figure 7:
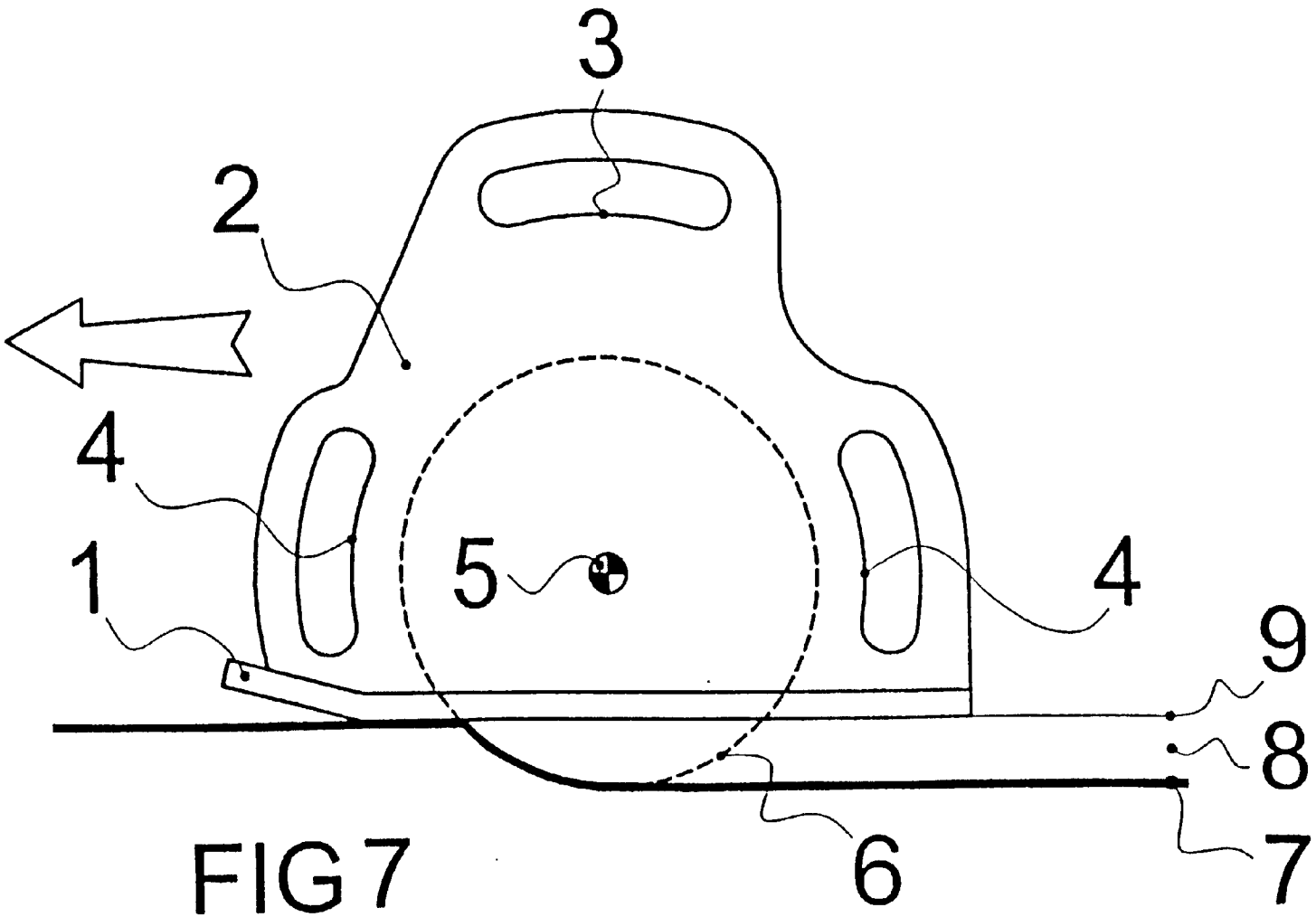

FIG. 6 and FIG. 7 illustrate other executions with different number and position of the guide slots (4). It is seen in the figures that the configuration of the slots is arch of circle shaped, the geometrical virtual centre of which coincides substantially with the centre of rotation (5) of the cutting drum (6) in all operational positions without altering the pre-set cutting depth.

In all figures, each single item is pointed out with the following numbers.

Element No. 1 shows the independent skids resting against the ground, integral with the side protection guards.

Element No. 2 shows the side independent guards integral with the skids.

Element No. 3 shows a curved slot in which the thrust pin is engaged (11) which establishes the cutting depth with the skids (1) resting against the ground.

Element No. 4 shows the curved slots in which the guide pin is engaged (10) which allows the guard to turn around the centre (5) of the cutting drum (6).

Element No. 5 shows the centre of the cutter.

Element No. 6 shows the cutting drum.

Element No. 7 shows the bottom of the chase being cut.

Element No. 8 shows the depth of the chase being cut.

Element No. 9 points out the ground level.

Element No. 10 points out a guide pin engaged in the slots (4) and fixed to the supporting structure (13).

Element No. 11 shows the thrust pin which establishes the cutting depth.

Element No. 12 shows the independent devices that activate the pin movement (11) to establish the cutting depth of the cutter.

Element No. 13 shows the supporting structure for fitting the cutter to an operating machine.

The clearness of the figures proves the operational simplicity of this invention and fully clarifies all operational aspects. Once the cutting depth (8) has been established, namely how far the cutting drum (6) protrudes compared to the position of the skids resting against the ground, this depth is automatically held constant without involving the operator. In fact the skids rest completely against the ground at all times even when the operational position of the operating machine is changed. The fact that the skids completely and constantly rest against the ground means that there is no projection to the side of cutting rubble in all cutting positions. It is pointed out that the schematic diagrams illustrate only one form of execution of the invention, which may be achieved in other executions varying both in terms of structural and dimensional proportioning and also in terms of construction material.

It goes without saying that skids and side guards are subject to various shape executions and that the features of the invention mainly consist of the presence of shape described and claimed are within the sphere of protection of the patent right.

What is claimed is:

1. A cold cutting equipment of road surfaces comprising:

side protection guards integral with skids that rest against the ground; and a cutting drum operably attached to a tiltable supporting structure, wherein the side protection guards include at least first and second curved slots with concave parts of the slots facing a central point, substantially coinciding with a center of rotation of the cutting drum, wherein a thrust pin is engaged in the first curved slot and a guide pin is engaged in the second curved slot, and wherein each thrust and guide pin is fixed to the supporting structure enabling the supporting structure to substantially tilt about the center of rotation of the cutting drum, allowing a substantial portion of the skids to rest against the ground at all times and to constantly maintain a chase cutting depth within operation tolerance limits that will not be subject to oscillation caused by a variation of position of the supporting structure due to uneven ground or irregular movements of the cutting equipment.

* * * * *

UNITED STATES PATENT AND TRADEMARK OFFICE

CERTIFICATE OF CORRECTION

PATENT NO. : 6,623,083 B1
DATED : September 23, 2003
INVENTOR(S) : Risi

It is certified that error appears in the above-identified patent and that said Letters Patent is hereby corrected as shown below:

Title page, Item [54] and Column 1, lines 1 and 2,
Title should read: -- IMPROVEMENTS TO THE EQUIPMENTS FOR COLD MILLING OF THE ROAD SURFACE --

Signed and Sealed this

Twenty-fourth Day of February, 2004

JON W. DUDAS
*Acting Director of the United States Patent and Trademark Office*